United States Patent [19]

Daimler

[11] Patent Number: 5,069,363

[45] Date of Patent: Dec. 3, 1991

[54] COMPRESSED GAS CONTAINER

[76] Inventor: Berthold H. Daimler, Hentzenalleid 13, 5630 Remscheid 11, Fed. Rep. of Germany

[21] Appl. No.: 496,903

[22] Filed: Mar. 21, 1990

[30] Foreign Application Priority Data

Dec. 8, 1989 [DE] Fed. Rep. of Germany ..... 3940601

[51] Int. Cl.[5] ..... B65D 83/14

[52] U.S. Cl. ..... 222/95; 222/1; 222/131; 222/212; 222/386.5

[58] Field of Search ..... 222/94, 95, 129–131, 222/145, 206, 209, 211, 212, 214, 183, 386.5, 409, 402.1

[56] References Cited

U.S. PATENT DOCUMENTS

| | | | |
|---|---|---|---|
| 3,240,394 | 3/1966 | Modderno | 222/95 |
| 3,705,667 | 12/1972 | Blanie et al. | 222/386.5 X |
| 3,828,977 | 8/1974 | Borchert | 222/95 |
| 4,458,830 | 7/1984 | Werding | 222/386.5 X |

FOREIGN PATENT DOCUMENTS 3132906 3/1983 Fed. Rep. of Germany .

OTHER PUBLICATIONS

Computerized Database Abstract of DE 3132906, Feb. 6, 1990.

*Primary Examiner*—Kevin P. Shaver
*Assistant Examiner*—Kenneth DeRosa
*Attorney, Agent, or Firm*—Kenyon & Kenyon

[57] ABSTRACT

A compressed gas container for spraying liquid from an essentially pressureless, compressable product receptacle which is enclosed by an elastically prestressed hollow cylinder made of elastomeric material. The hollow cylinder is able to expand in one direction only and is acted upon by a pressurized gas provided in a clearance space between the product receptacle and the hollow cylinder. The clearance space is hermetically sealed to the outside and is filled, while the product receptacle is empty, with the pressurized gas having a pressure of approximately $P_{min}$. The liquid to be sprayed is fed into the product receptacle in such an amount that the gas contained in the free space reaches a pressure of approximately $P_{max}$. The pressure of the gas in the free space varies, as a function of the amount of product in the product receptacle, between the minimum pressure $P_{min}$ and the maximum pressure $P_{max}$.

17 Claims, 1 Drawing Sheet

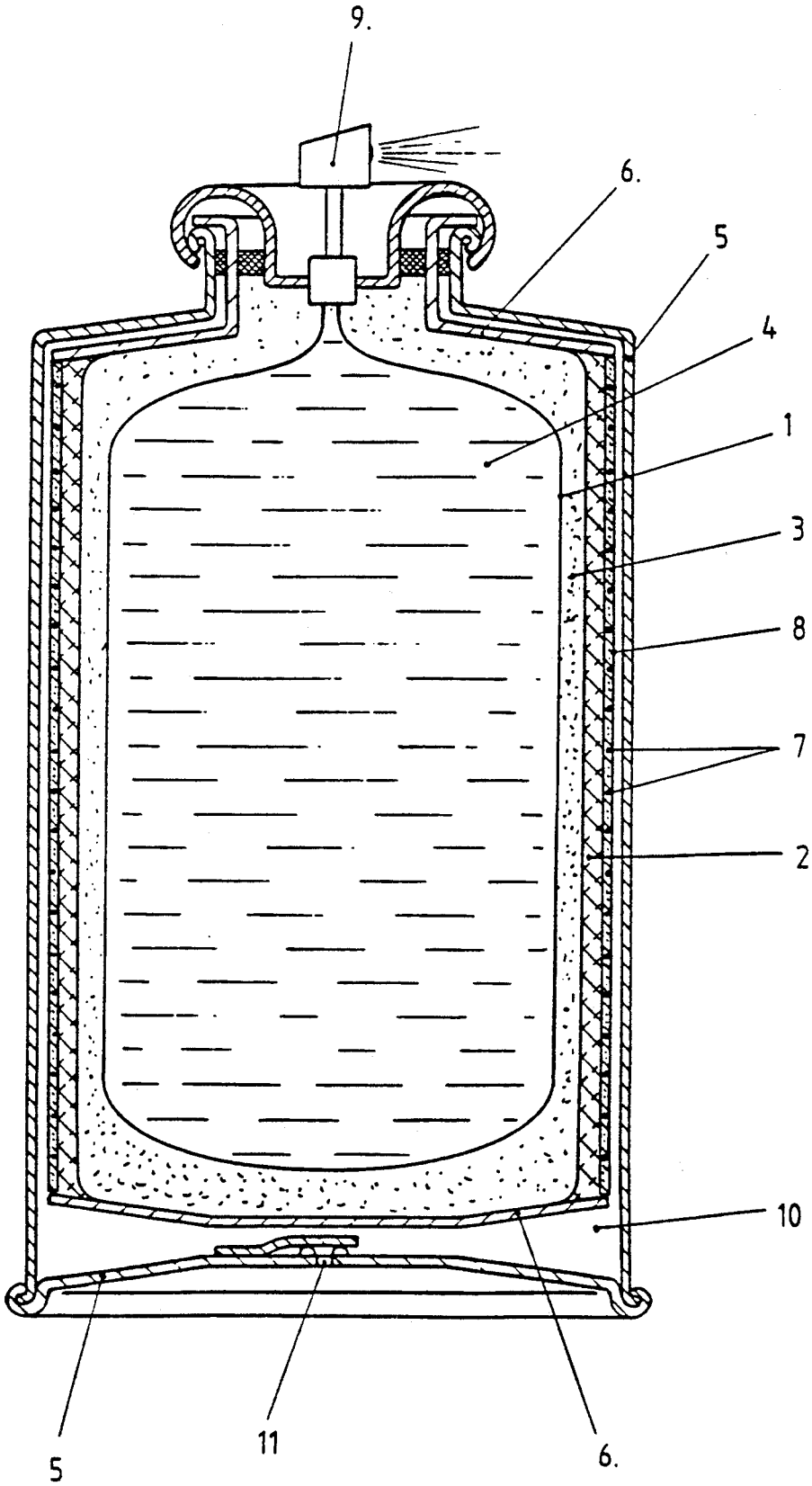
9.
6.
5
4
1
3
8
7
2
10
5
11
6.

COMPRESSED GAS CONTAINER

BACKGROUND OF THE INVENTION

The invention relates to compressed gas containers in general and, in particular, to an improved container for dispensing a product from an essentially pressureless, compressable product receptacle, which is enclosed by an elastically prestressed hollow cylinder forming a sealed clearance space containing a pressurized gas.

A container for spraying a liquid from a product receptacle enclosed by an elastically prestressed hollow cylinder made of elastomeric material is disclosed in DE-OS 3132906. As is evident from FIGS. 1-3 of this document, the hollow cylinder is expandable in one direction only, i.e. the longitudinal direction, and is elastically prestressed in this direction. The hollow cylinder is connected with a base that forms a can-like enclosure occupying the volume of the cylinder. The liquid to be sprayed is contained between the prestressed hollow cylinder and the can-like member. In the embodiments of FIGS. 9-10, an essentially pressureless, compressable product receptacle is provided which is pressurized by the con-like member. The pressure varies, as a function of the amount of liquid in the product receptacle, between a minimum pressure $P_{min}$ and a maximum pressure $P_{max}$.

This type of device has numerous disadvantages. In addition to the high manufacture and assembly costs, the pressure drop that results during evacuation of the container is too large. This can cause a change in the consistency of the spray mist, which is intolerable. It is possible to reduce the pressure drop by increasing the initial stress applied while the product receptacle is completely empty, relative to the maximum pressure of the hollow cylinder. However, this results in other disadvantages which must be taken into account, such as a loss of delivery power and, thus, a lesser degree of admission of the product, i.e., a reduced amount of product relative to the size of the hollow cylinder.

SUMMARY OF THE INVENTION

The invention is directed to the problems of providing a compressed gas container for spraying or otherwise dispensing products that can be more simply produced and allows greater degrees of admission, i.e., increased amounts of product to be contained within the container, than heretofore possible. If the product to be dispensed from the product receptacle is a liquid, it must be able to be sprayed without residue at a pressure that lies within the range of optimum spray mist formation defined by $P_{min}$ and $P_{max}$.

The invention solves these problems and avoids the disadvantages of the prior art by providing a compressed gas container for dispensing a product from the container that includes an essentially pressureless, compressable product receptacle and an elastically prestressed, hollow cylinder enclosing the product receptacle. The hollow cylinder is formed of elastomeric material and expandable in one direction only. A hermetically sealed clearance space is formed between the product receptacle and the hollow cylinder. The clearance space contains a gas which, when the product receptacle is empty, has a minimum pressure of approximately $P_{min}$, and when the product receptacle is full, contains product to be dispensed in an amount such that the gas in the clearance space has a maximum pressure of approximately $P_{max}$. The pressure of the gas varies, as a function of the amount of product contained in the product receptacle, between the minimum pressure $P_{min}$ and the maximum pressure $P_{max}$. When the product to be dispensed is a liquid to be sprayed from the container, $P_{min}$ is the minimum pressure at which an optimal spray mist is produced and $P_{max}$ is the maximum pressure at which an optional spray mist is produced.

In the compressed gas container of the invention, the clearance space between the product receptacle and the hollow cylinder is hermetically sealed to the outside environment and, while the product receptacle is empty, the hollow cylinder is filled with a gas having a pressure of approximately $P_{min}$. The liquid then may be fed into the product receptacle in an amount such that the gas contained in the clearance space reaches the pressure of approximately $P_{max}$. Due to the pressureless ductility of the product receptacle, the prevailinq pressure in the clearance space is transferred without any losses to the liquid contained in the product receptacle. Therefore, the liquid is always available, when the discharge valve of the product receptacle is actuated, to be dispensed at a pressure that lies between $P_{min}$ and $P_{max}$. The liquid may be sprayed in an optimum manner within this range. Hence, the undesirable formation of droplets on the outlet nozzle of the discharge valve thereby is avoided throughout the useful life of the container, regardless of whether the product receptacle is completely full or has reached its empty state.

In the compressed gas container to the invention, the clearance space in the hollow cylinder is filled completely by a cushion of compressed gas. The elastic characteristics of the hollow cylinder are supplemented by the cushion in an advantageous manner. The gas that forms the cushion preferably may be argon or air. Therefore, specific measures required to attain good environmental qualities are obviated.

In order to guarantee reliable operation in case the compressed gas container of the invention is stored for a long period of time prior to use, it is advantageous to fill the clearance space with a diffusion-proof gas, e.g., argon, or to isolate the clearance space from the surroundings by means of a gas-tight diffusion barrier. The diffusion barrier may be a coating of a ductile material, e.g., a coating of a known sealing material such as those used in the tire industry, which is applied to the inside or outside surfaces of the hollow cylinder. In addition, an outer cylinder that surrounds the outside of hollow cylinder may be provided as a diffusion barrier. Preferably, the outer cylinder is formed from a metallic material and may serve simultaneously to identify the contents of the container and/or advertise the product.

If an outer cylinder is used as a diffusion barrier, the interspace formed between the outer cylinder and the hollow cylinder may be filled with air. The air in the interspace may be pre-pressurized to a predetermined pressure P for elastically supporting the hollow cylinder when the product receptacle is filled. In any event, the pressure P should be regulated such that, when the product receptacle is completely empty, at least atmospheric pressure is reached in the interspace. Pressure losses by diffusion from the clearance space are able to be compensated, to a certain extent, by the outer cylinder, since a drop in pressure in the clearance space results in a corresponding increase of pressure in the interspace. Should the over-pressure arising in the interspace be undesirable while filling the product receptacle or the clearance space, a valve may be provided in the wall of the outer cylinder, which can be actuated to expel the compressed air. Afterwards, the valve closes automatically so that gas that eventually diffuses during storage from the clearance space into the interspace causes a compensatory increase of pressure therein. On the other hand, before an under-pressure can occur in the interspace during rapid evacuation, an adjustment with the atmosphere takes place by automatic opening of the valve.

Further features, advantages and embodiments of the invention are apparent from consideration of the following detailed description, drawing and appended claims.

BRIEF DESCRIPTION OF THE DRAWING

The sole drawing FIGURE illustrates a longitudinal cross-sectional view of a compressed gas container constructed in accordance with the principles of the invention.

DETAILED DESCRIPTION

The compressed gas container of the illustrated embodiment utilizes the pressure of compressed gas in the container to spray a liquid 4 from an essentially pressureless, compressable product receptacle 1. The product receptacle 1 is enclosed by an elastically prestressed, hollow cylinder 2 made of elastomeric material, which can expand in the longitudinal direction only and is attached to a pair of bases 6 near its ends. Bases 6 are deep drawn, metallic molded parts. The upper base serves to locate the hollow cylinder 2 in a metallic outer cylinder 5. The hollow cylinder 2 is reinforced near its outer surface by metallic rings 7, which are unable to expand under normal operating conditions and are longitudinally spaced from each other. The cylinder 2 also may be covered with an elastically expandable coating of butyl caoutchouc (rubber), which acts as a diffusion barrier 8. This coating, together with the hollow cylinder 2, is ductile.

The clearance space 3 formed between the product receptacle 1 and the hollow cylinder 2 may be filled with air to prestress the receptacle 1. While the product receptacle 1 is empty, this air is pressurized to a pressure $P_{min}$, which, during normal application when the spray valve 9 is actuated, is still sufficient to produce optimal spraying of the liquid 4 contained in the product receptacle 1. The minimum pressure necessary to produce optimal spraying is a function of the type of the liquid to be sprayed. This pressure can be determined by simple tests, which are known in the art.

To prepare the compressed air container of the invention for use, the liquid 4 is fed into the product receptacle in such an amount that the air contained in the clearance space 3 reaches the pressure $P_{max}$, which is the maximum pressure at which the optimal spray pattern is also attained. The hollow cylinder 2, which is prestressed and partly expanded when the pressure in space 3 is at $P_{min}$, assumes its maximum allotted expansion when the pressure $P_{max}$ is reached. The maximum pressure value at which optimal spraying occurs also is a function of the type of liquid to be sprayed, as well as the nozzle used, and may be determined by simple tests, which are known in the art.

In the illustrated embodiment, the hollow cylinder 2 is surrounded on the outside by an outer cylinder 5, which is connected to the cylinder 2, near the upper base 6. The outer cylinder 5 may be formed from a metallic material and thereby is both diffusion-proof, i.e., impermeable to gas, and pressure resistant. The outer cylinder 5 is spaced at a uniform clearance from the hollow cylinder 2, as well as from its lower base 6, in the illustrated condition of the product receptacle 1, which is filled to the upper limit. The interspace 10 formed by this clearance is filled with air at a pressure P while the product receptacle is empty. The pressure P is at least as great as atmospheric pressure. In the completely filled condition of the product receptacle 1 shown, the pressure of the gas contained in the interspace 10 is considerably higher than atmospheric. The hollow cylinder 2 is resiliently supported by this pressure. In addition, a certain reduction in the pressure losses occurring in the free space 3, which can arise by virtue of diffusion during long storage periods, is realized.

The increased pressure of the gas prevailing inside the hollow cylinder 2 guarantees a complete evacuation of the product receptacle 1 at the predetermined pressure $P_{min}$. Both the hollow cylinder 2, which is able to expand in one direction only due to a reinforcement, such as rings 7, as well as the product receptacle 1, may have a different shape than that depicted. The same is true for the overall form of the compressed gas container of the invention. Furthermore, one or more openings having a valving function, in addition to opening 11 explicitly shown, may be provided to adjust the gas pressure in the clearance space 3 and/or in the interspace 10.

The compressed gas container of the invention also may be used to dispense more viscous, paste-like products. The high degree of admission of the product to be dispensed, which is attainable at an especially low pressure difference between $P_{max}$ and $P_{min}$, is equally advantageous in this application of the invention and helps achieve a greater uniformity of the product being dispensed.

What is claimed is:

1. A compressed gas container for dispensing a product comprising:

an essentially pressureless, compressable product receptacle;

an elastically prestressed, hollow cylinder enclosing the product receptacle, said hollow cylinder being formed of elastomeric material and being expandable in one direction only;

a clearance space formed between the product receptacle and the hollow cylinder, said clearance space being hermetically sealed from ambient and containing a gas which, when the product receptacle is empty, has a minimum pressure of approximately $P_{min}$; and a product to be dispensed contained in the product receptacle in an amount such that the gas in the clearance space has a maximum pressure of approximately $P_{max}$, whereby the pressure of the gas varies, as a function of the amount of product contained in the product receptacle, between the minimum pressure $P_{min}$ and the maximum pressure $P_{max}$.

2. The compressed gas container of claim 1 wherein the product contained in the product receptacle is a liquid and further comprising an actuator operably coupled to the product receptacle for producing a spray mist of the liquid, whereby $P_{min}$ is the approximate minimum pressure at which an optimal spray mist is produced and $P_{max}$ is the approximate maximum pressure at which an optimal spray mist is produced.

3. The compressed gas container of claim 2 wherein said gas comprises argon.

4. The compressed gas container of claim 2 wherein said gas comprises air.

5. The compressed gas container of claim 2 further comprising a gas-tight diffusion barrier isolating said clearance space from ambient.

6. The compressed gas container of claim 4 further comprising a gas-tight diffusion barrier isolating said clearance space from ambient.

7. The compressed gas container of claim 6 wherein said diffusion barrier comprises a coating of ductile material applied to the hollow cylinder.

8. The compressed gas container of claim 6 wherein said diffusion barrier comprises an outer cylinder surrounding the hollow cylinder.

9. The compressed gas container of claim 8 wherein said outer cylinder comprises a metallic material.

10. The compressed gas container of claim 8 wherein said outer cylinder surrounds the hollow cylinder at a distance to form an interspace therewith, said interspace being filled with air.

11. The compressed gas container of claim 9 wherein said outer cylinder surrounds the hollow cylinder at a distance to form an interspace therewith, said interspace being filled with air.

12. The compressed gas container of claim 10 wherein the air contained in the interspace has a pressure P when the product receptacle is empty that is at least as great as atmospheric pressure.

13. The compressed gas container of claim 11 wherein the air contained in the interspace has a pressure P when the product receptacle is empty that is at least as great as atmospheric pressure.

14. The compressed gas container of claim 12 wherein said outer cylinder has a wall in which an opening is provided, said opening including a back pressure valve permitting air to flow into the interspace from outside the container.

15. The compressed gas container of claim 13 wherein said outer cylinder has a wall in which an opening is provided, said opening including a back pressure valve permitting air to flow into the interspace from outside the container.

16. A method of making a compressed gas container for dispensing a product comprising the steps of:

a) positioning an essentially pressureless, compressable product receptacle within an elastically prestressed, hollow cylinder formed of elastomeric material and being expandable in one direction only such that a clearance space is formed between the product receptacle and the hollow cylinder;

b) hermetically sealing the clearance space from ambient;

c) filling the clearance space with a gas having a minimum pressure of approximately $P_{min}$ when the product receptacle is empty, where $P_{min}$ is the approximate minimum pressure at which optimal dispensing occurs; and d) filling the product receptacle with a product to be dispensed from the container in an amount such that the pressure of the gas in the clearance space is approximately $P_{max}$, where $P_{max}$ is the approximate maximum pressure at which optimal dispensing occurs.

17. The method of claim 16 wherein the product to be dispensed from the product receptacle is a liquid and $P_{min}$ is the approximate minimum pressure at which an optimal spray is produced and $P_{max}$ is the approximate maximum pressure at which an optimal spray mist is produced.

* * * * *